US006752644B2

(12) United States Patent
Shibata

(10) Patent No.: US 6,752,644 B2
(45) Date of Patent: Jun. 22, 2004

(54) WATERTIGHT CONNECTOR

(75) Inventor: Takahiro Shibata, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/383,378

(22) Filed: Mar. 6, 2003

(65) Prior Publication Data

US 2003/0171020 A1 Sep. 11, 2003

(30) Foreign Application Priority Data

Mar. 7, 2002 (JP) ..... 2002-061998

(51) Int. Cl.[7] ..... H01R 13/52
(52) U.S. Cl. ..... 439/271; 439/587
(58) Field of Search ..... 439/271, 587

(56) References Cited

U.S. PATENT DOCUMENTS 5,108,303 A * 4/1992 Maeda et al. ..... 439/271
5,197,898 A * 3/1993 Nagamine ..... 439/271
6,126,468 A 10/2000 Matsushita et al. ..... 439/271

* cited by examiner

*Primary Examiner*—Tho D. Ta
(74) *Attorney, Agent, or Firm*—Anthony J. Casella; Gerald E. Hespos

(57) ABSTRACT

A seal (30) is mounted on the outer periphery of a fittable portion (11) of a housing (10), and resilient contacts (31F, 31R) at a front end of the seal (30) closely contact a receptacle (Mc) to provide sealing. The resilient contacts (31F, 31R) may be pushed back by frictional resistance during a fitting operation into the receptacle (Mc). However, steps (19, 34) prevent the resilient contacts (31F, 31R) from being pulled by the receptacle (Mc) and moved back loosely. Thus, even if the seal (30) is long along forward and backward directions and the resilient contacts (31F, 31R) are at the front end of the seal (30), the seal (30) is prevented from buckling.

12 Claims, 7 Drawing Sheets

WATERTIGHT CONNECTOR

BACKGROUND OF THE INVENTION

1. Field of the Invention

The present invention relates to a watertight connector.

2. Description of the Related Art

A known watertight connector has a housing with opposite front and rear ends. A fittable portion is disposed at the front end of the housing and is dimensioned to fit in a receptacle of a mating connector. Terminal fittings are mounted in the fittable portion and a tubular seal is mounted on the outer peripheral surface of a fittable portion. The seal seals a clearance between the outer peripheral surface of the fittable portion and the inner peripheral surface of the receptacle.

A holder is provided at the rear end of the fittable portion of the housing and a lock is formed at the rear end of the seal to prevent the seal from coming off the fittable portion when the watertight connector is withdrawn from the receptacle. The lock engages the holder to prevent loose forward movements of the seal and separation of the seal from the fittable portion.

It generally is desirable to shorten the seal along forward and backward directions to reduce connection resistance with the receptacle and to prevent the seal from buckling. Thus, the seal is at a rear end of the fittable portion and is held resiliently in contact with a front area of the receptacle.

The mating connector often is on a fixed piece of equipment and the watertight connector may have to be fit into the receptacle by touch due to a narrow space near the receptacle. Thus, the opening to the receptacle may be slanted outwardly to guide the insertion of the fittable portion. However, the degree of resilient deformation of the seal with the slanted surface changes depending on the depth of engagement of the fittable portion, and sealing performance is unstable. Accordingly, the slanted leading end cannot be a sealing surface. A portion of the receptacle more backward than the slanted opening is set as a sealing surface for resilient contact with the seal, and a resilient contact of the seal with the receptacle is near the front-end of the fittable portion.

The rear end of the seal is held at the rear end of the fittable portion so as not to come off. Thus, the seal must be longer along forward and backward directions if an attempt is made to position the resilient contact of the seal at the front end of the fittable portion. However, frictional resistance pushes the resilient contact portion of a longer seal back during the fitting operation, and hence the longer seal may buckle.

The present invention was developed in view of the above problems and an object thereof is to prevent a sealing member from being buckled.

SUMMARY OF THE INVENTION

The invention relates to a watertight connector with a housing in which at least one terminal fitting is accommodated. The watertight connector has a fittable portion that can be fit in and withdrawn from a receptacle of a mating connector. A substantially tubular seal is mounted on the outer peripheral surface of the fittable portion and is formed on its outer peripheral surface with at least one resilient contact that is held resiliently in contact with the inner peripheral surface of the receptacle. One or more fastening means are provided at the rear end of the fittable portion and/or at the rear end of the seal for preventing the seal from moving forward and off the fittable portion. One or more loose-movement preventing means are provided on the fittable portion and on the seal for preventing loose backward movement of the resilient contact.

The fastening means preferably are provided at the rear end of the fittable portion and/or at the rear end of the seal.

The loose-movement preventing means preferably is at the fittable portion and at the seal and engage each other to prevent loose backward movement of the resilient contact.

Frictional resistance that acts during the fitting of the watertight connector into the receptacle may push the resilient contact back. However, the loose-movement preventing means prevents the resilient contact from moving loosely backward in response to forces exerted by the receptacle. Thus, the seal will not buckle even if the seal is long along forward and backward directions and the resilient contact is at the front-end of the seal.

The loose-movement preventing means preferably comprises steps on the outer peripheral surface of the fittable portion and on the inner peripheral surface of the seal. The steps prevent the loose movements of the resilient contact by bringing into contact surfaces of the steps aligned at an angle to a fitting direction of the fittable portion into the receptacle.

A backward-acting pushing force exerted by the receptacle on the resilient contact is received by the step of the fittable portion via the step of the seal. The surfaces of the steps intersect the fitting direction of the fittable portion into the receptacle. Thus, the fittable portion can receive the pushing force from the receptacle to prevent loose backward movements of the resilient contact.

The steps of the fittable portion and the seal prevent the loose movements of the resilient contact by bringing into contact surfaces that overhang or are undercut with respect to the fitting direction. Thus, an acute-angled corner of each step bites in or engages an angled corner of the mating step due to the inclination of the overhanging surface to prevent the loose movements of the resilient contact. Accordingly, disengagement of the steps and loose movements of the resilient contact can be avoided.

The step of the seal is at a position near the resilient contact with respect to forward and backward directions.

The backward pushing force of the receptacle on the resilient contact deforms the resilient contact inwardly and the restoring force of the resilient contact presses the step of the seal against the outer peripheral surface of the fittable portion. Accordingly, the step of the seal will not disengage outwardly from the step of the fittable portion and loose movements of the resilient contact are prevented.

An escaping groove is formed in an area of the inner surface of the fittable portion that faces the terminal insertion space in the housing. The escaping groove avoids interference with an improper insertion preventing projection on the outer surface of the terminal fitting when the terminal fitting is inserted in a proper orientation. An area of the outer surface of the fittable portion corresponding to the escaping groove preferably forms a rib shape, and the front end of the rib-shaped projection defines the step.

A nonuniform thickness of the wall of the fittable portion can be reduced by forming the rib shape on the outer surface of the fittable portion to align with the escaping groove. Thus, a variation in the degree of deformation caused by thermal shrinkage (i.e. "sink marks") during the resin molding of the housing can be suppressed to ensure dimensional stability. Further, the step of the fittable portion takes advantage of the rib-shaped projection corresponding to the escaping groove. Accordingly, the shape of the fittable portion can be simplified as compared to a case where the step is separate from the rib-shaped projection.

The fastening means may comprise a stopper fit to the housing for engaging the seal and preventing the seal from moving forward.

A single loose-movement preventing means may be provided on each of the fittable portion and the seal around substantially the entire periphery thereof.

Alternatively, a plurality of loose-movement preventing means may be spaced around the periphery of the fittable portion and/or the seal.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A watertight connector F to be connected to a mating connector M is described with reference to FIGS. 1 to 9. The mating connector M has a main body Ma and male terminal fittings are mounted in, the main body Ma so that tabs Mb at the leading ends of the male terminal fittings project from the front end of the main body Ma. A substantially tubular receptacle Mc projects forward from the outer periphery of the front-end of the main body Ma for substantially surrounding and protecting the tabs Mb. The inner periphery of the receptacle Mc is substantially rectangular when viewed from the front and has four quadrantal corners. Additionally, the inner periphery of the receptacle Mc is substantially symmetrical with respect to a center axis P, and hence has the same shape even if rotated by 180°. An outwardly slanted inner peripheral guide surface Md is formed at the open front end of the receptacle Mc, and an inner peripheral sealing surface Me is formed in the receptacle Mc rearwardly of the slanted guide surface Md. The sealing surface Me is substantially parallel with the center axis P.

Figure 1:
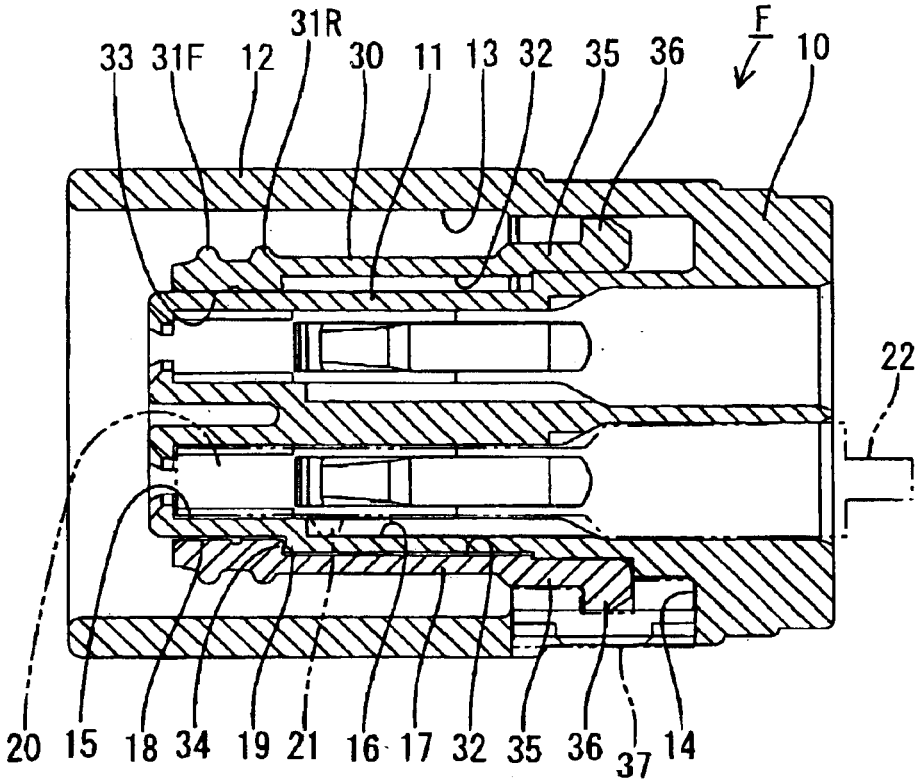
FIG. 1 is a horizontal section of a watertight connector according to one embodiment of the invention.

The side of the watertight connector F that mates with the mating connector M (i.e. a left side in FIG. 1) is referred to as the front side herein, and the upper side in FIG. 1 is referred to as the right side. The watertight connector F has a housing 10 made e.g. of a synthetic resin, and a substantially front half of the housing 10 defines a fittable portion 11 that can fit into the receptacle Mc. The outer periphery of the fittable portion 11 is similar to, but slightly smaller than, the inner periphery of the receptacle Mc. Specifically, when viewed from the front, the outer periphery of the fittable portion 11 is substantially rectangular with four quadrantal corners and is substantially symmetrical with respect to the center axis P so that the fittable portion 11 has substantially the same shape even if rotated by 180°. The housing 10 has a tubular fittable portion 12 that surrounds the fittable portion 11 over the entire circumference, and the receptacle Mc can be fit into a tubular space 13 between the outer circumferential surface of the fittable portion 11 and the inner circumferential surface of the tubular fittable portion 12.

A holding space 14 is formed at a rear end of the fittable portion 11 and defines a recess at a left-side of the back end surface of the tubular space 13. The holding space 14 opens to the outer surface of the housing 10. Left and right cavities 15 are formed in the housing 10, and an escaping groove 16 is formed in the left inner wall surface of each cavity 15. The escaping grooves 16 extend substantially parallel with the inserting direction ID the respective cavities 15.

A rib-shaped projection 17 extends forward and back on the left side surface of the fittable portion 11 outwardly from the escaping groove 16. The front end of the projection 17 is slightly behind the front end of the fittable portion 11, and a continuous circumferentially smooth sealing surface 18 is defined on the outer periphery of the fittable portion 11 forward of the projection 17. The front end of the projection 17 forms a step 19 with respect to the rear end of the sealing surface 18, and a receiving surface 19S is defined at the front of the step 19. The receiving surface 19S is undercut with respect to the fitting direction FD of the fittable portion 11 into the receptacle Mc (see FIG. 4). Thus, an acute angle corner is formed between the receiving surface 19S and the sealing surface 18. Further, the projection 17 has a thickness between the bottom surface (left surface) of the escaping groove 16 and the projecting end surface (left surface) of the projection 17 that substantially equals the thickness between the inner surface of the front end of the left cavity 15 and the sealing surface 18 of the fittable portion 11.

A female terminal fitting 20 connected with a wire 22 is inserted into each cavity 15 from behind along an inserting direction ID. An improper insertion preventing projection 21 is formed on the left side of each female terminal fitting 20 to prevent the female terminal fitting 20 from being inserted into the cavity 15 in an improper rotational orientation. The improper insertion preventing projection 21 of a properly oriented female terminal fitting 20 is received in the escaping groove 16 in the left inner wall of each cavity 15.

The watertight connector F further includes a substantially tubular seal 30 made of a resilient material such as a rubber. The inner and outer peripheral shapes of the seal 30 are similar to the outer peripheral surface of the fittable portion 11 and the inner peripheral surface of the receptacle Mc, respectively. Two resilient contacts 31F, 31R are formed one after the other on the outer peripheral surface of a front end portion of the seal 30 and are extend around the entire periphery. Long narrow recesses 32 extend forward and back along the inner surfaces of the left and right side walls of the seal 30 and reach the rear edge of the seal 30. A smooth continuous sealing surface 33 is formed on the inner periphery of the seal 30 forward of the recesses 32. Thus, steps 34 are formed at the front ends of the recesses 32 adjacent the sealing surface 33, and rearwardly facing contact surfaces 34S are defined by the steps 34. The contact surfaces 34S are undercut with respect to the fitting direction FD of the fittable portion 11 into the receptacle Mc. Thus, corners formed between the contact surfaces 34S and the sealing surface 33 define acute angles. The steps 34 are at substantially the same longitudinal position as the rear resilient contact 31R.

Locks 35 extend back at the rear of the left and right walls of the seal 30, and a locking piece 36 projects out at the rear end of each lock 35. A main body of the seal 30 is substantially rectangular when viewed from the front and has four quadrantal corners. The entire shape of the seal, including the left and right recesses 32 and the left and right locks 35, is symmetrical with the center axis P, and hence is the same even if rotated by 180°.

The seal 30 can be mounted on the outer peripheral surface of the fittable portion 11 from the front along a direction substantially opposite to the fitting direction FD. The left recess 32 of the properly mounted seal 30 engages the rib-shaped projection 17, and the steps 19, 34 engage to bring the contact surface 34S of the seal 30 into contact with the receiving surface 19S of the receptacle 11 from the front. Further, the sealing surfaces 18, 33 of the fittable portion 11 and the seal 30 closely contact each other over substantially the entire periphery, and the locks 35 at the rear end of the seal 30 enter the holding space 14 of the housing 10. A stopper 37 is fit into the holding space 14 from the outside of the housing 10 substantially normal to the fitting direction FD. The stopper 37 engages the locking piece 36 from the front to prevent the seal 30 from making loose forward movements with respect to the fittable portion 11.

Figure 2:
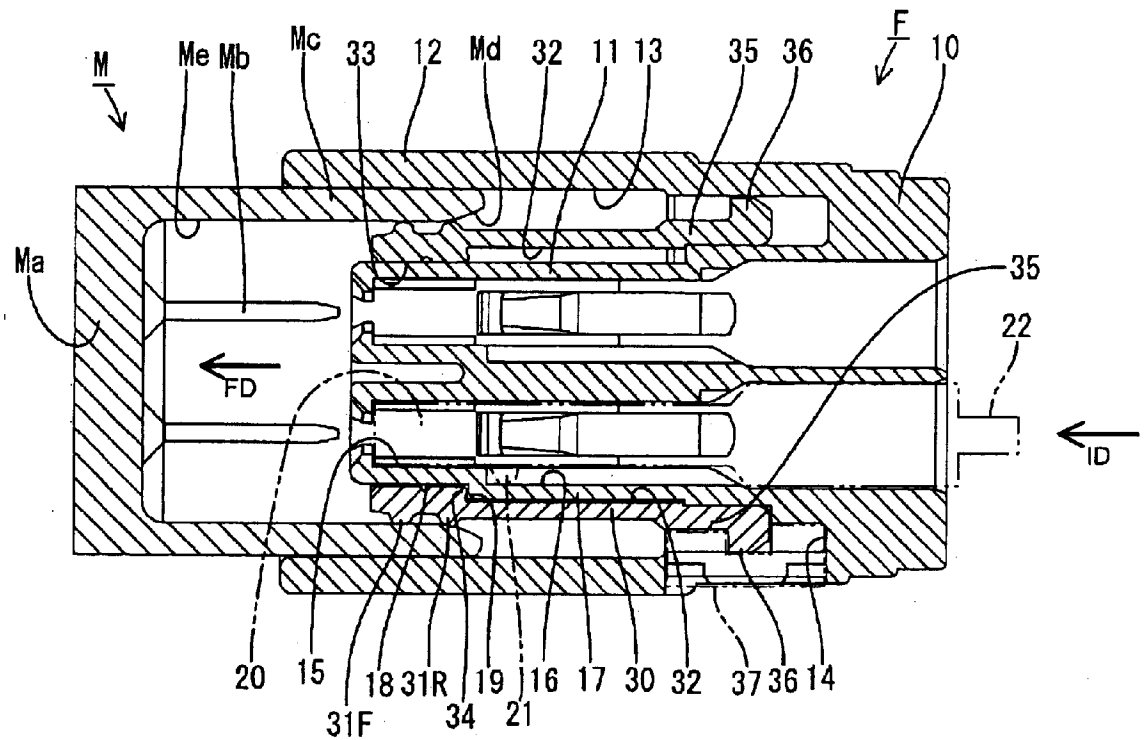
FIG. 2 is a horizontal section showing a connecting process with a mating connector.
Figure 3:
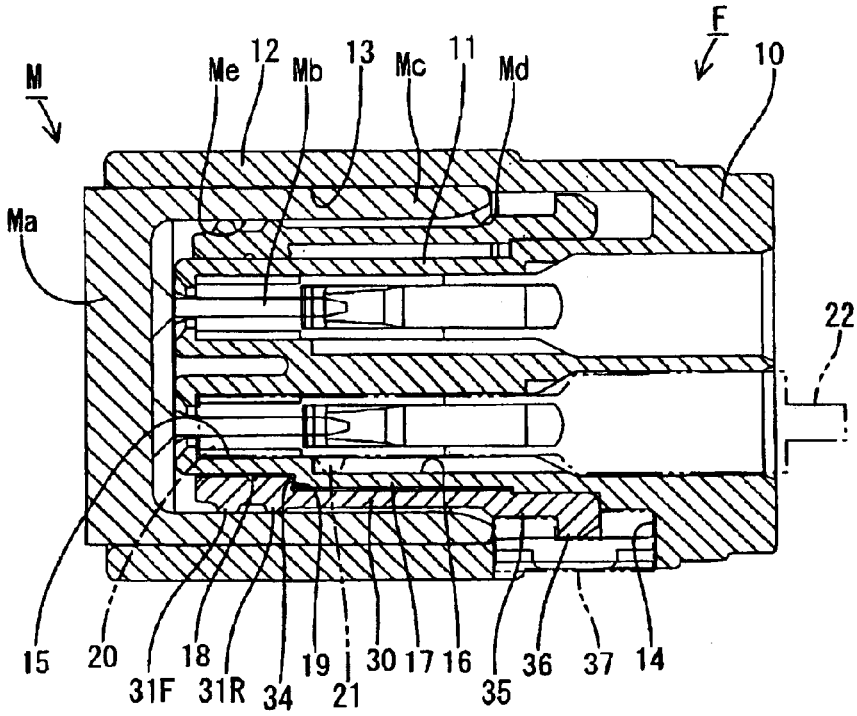
FIG. 3 is a horizontal section showing a state where connection with the mating connector is completed.
Figure 4:
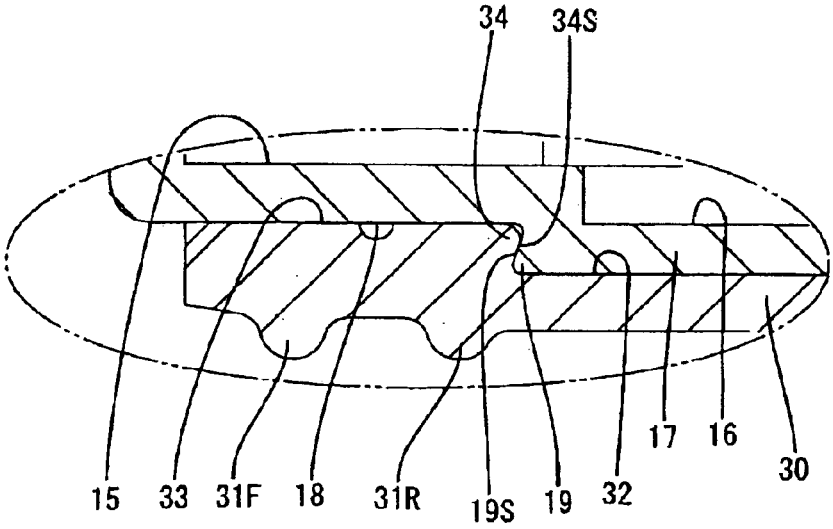
FIG. 4 is a partial enlarged horizontal section showing an engaged state of stepped portions.
Figure 5:
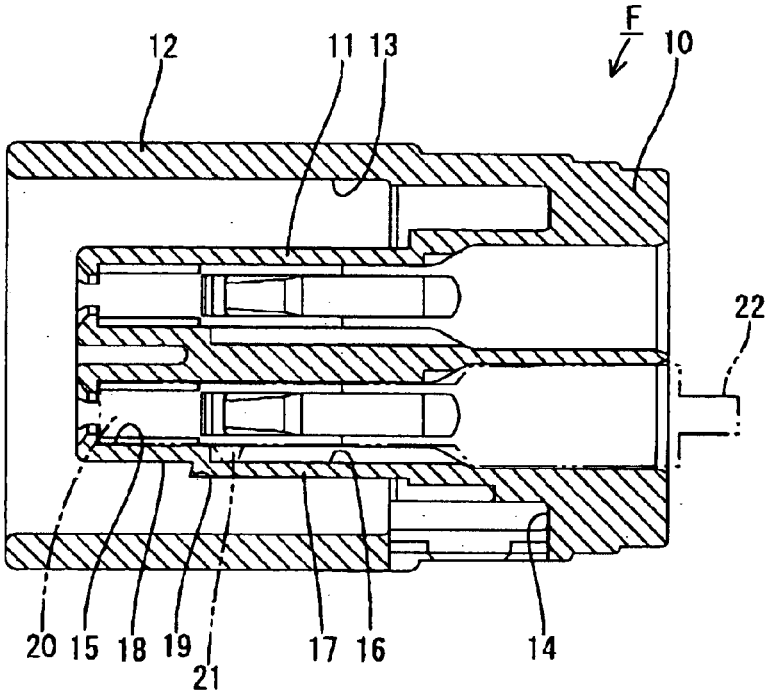
FIG. 5 is a horizontal section of a housing.
Figure 6:
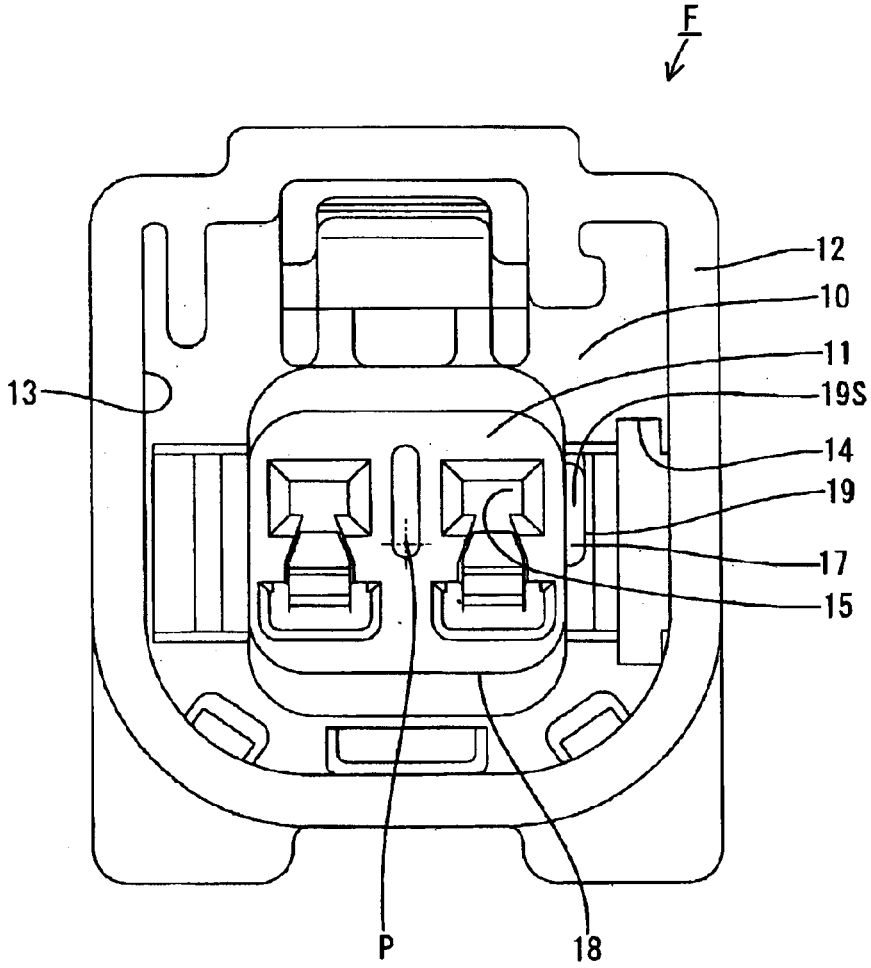
FIG. 6 is a front view of the housing.
Figure 7:
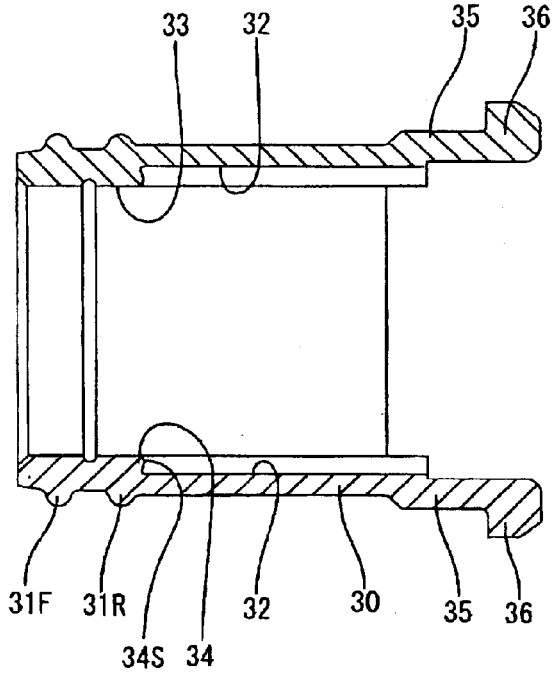
FIG. 7 is a horizontal section of a sealing member.
Figure 8:
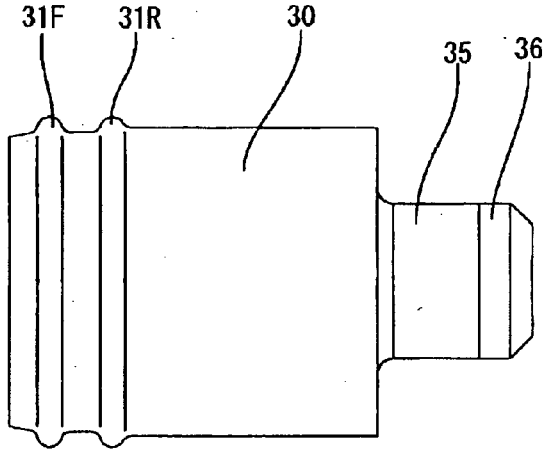
FIG. 8 is a side view of the sealing member.
Figure 9:
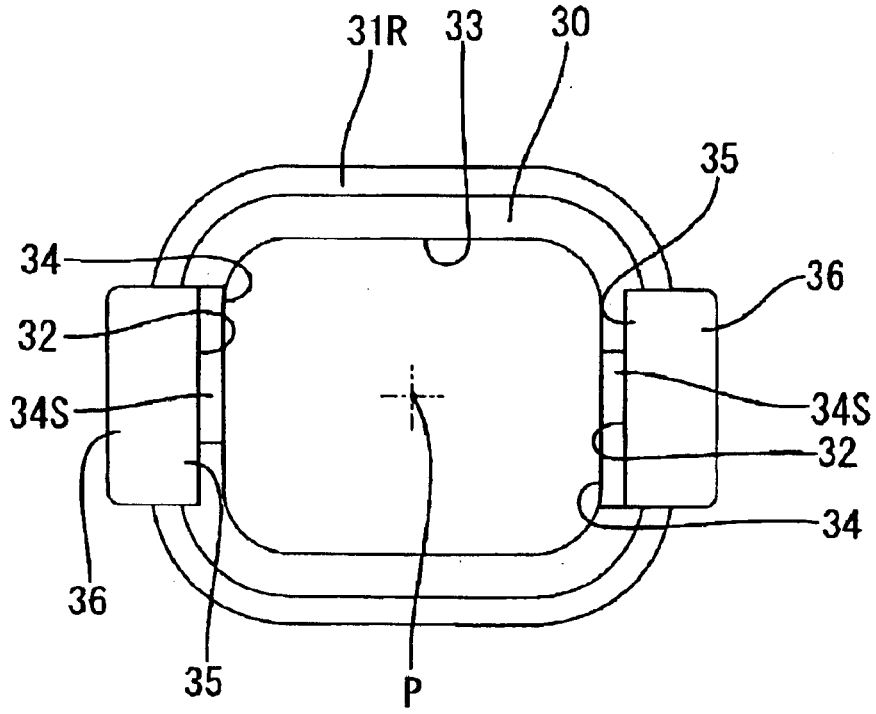
FIG. 9 is a rear view of the sealing member.

The assembled watertight connector F is inserted into the receptacle Mc of the mating connector M along in the fitting direction FD. Thus, the guide surface Md at the front end of the receptacle Mc passes the front and rear resilient contacts 31F, 31R and a portion of the inner peripheral surface of the receptacle Mc behind the guide surface Md engages the resilient contacts 31F, 31R as shown in FIG. 2. At this time, the resilient contacts 31F, 31R are deformed resiliently and squeezed. As a result, frictional resistance acts between the resilient contacts 31F, 31R and the receptacle Mc due to the resilient restoring forces of the resilient contacts 31F, 31R, and the frictional resistance generated by the receptacle Mc gives a backward-acting force to the resilient contacts 31F, 31R. However, the steps 19, 34 engage slightly behind the resilient contacts 31F, 31R to prevent loose backward movement of the resilient contacts 31F, 31R. Thus, the resilient contacts 31F, 31R and the front-end portion of the seal 30 are not displaced backward by the pushing forces of the receptacle Mc, and the seal 30 is free from buckling deformation.

The contact surface 34S of the seal 30 and the receiving surface 19S of the fittable portion 11 both are undercut with respect to the fitting direction FD of the fittable portion 11 into the receptacle Mc instead of being normal thereto. Thus, acute-angled corners of the steps 19, 34 bite in or engage acute-angled corners of the mating steps 34, 19. Therefore, the engagement of the steps 19, 34 reliably prevents loose backward movements of the resilient contacts 31F, 31R.

The resilient contacts 31F, 31R of the seal 30 are deformed resiliently and held in close contact with the sealing surface Me of the receptacle Mc when the fittable portion 11 is fit completely into the receptacle Mc. Additionally, the sealing surface 33 on the inner periphery of the seal 30 is held in close contact with the sealing surface 18 on the outer periphery of the fittable portion 11 by the resilient restoring forces of the resilient contacts 31F, 31R. As a result, the clearance between the inner and outer peripheral surfaces of the receptacle Mc and the fittable portion 11 are sealed hermetically.

Frictional resistance between the resilient contacts 31F, 31R and the receptacle Mc creates a forward-acting pulling force on the seal 30 when the fittable portion 11 is withdrawn from the receptacle Mc. However, the rear end of the seal 30 is held on the housing 10 so as not to make any loose forward movement. Thus, the seal 30 cannot be moved loosely forward or detached from the fittable portion 11.

Frictional resistance may push the resilient contacts 31F, 31R back when the watertight connector F is pushed along the fitting direction FD into the receptacle Mc. However, the steps 19, 34 engage to prevent the resilient contacts 31F, 31R from moving loosely back into the receptacle Mc. Thus, the seal 30 will not buckle even if the seal 30 is long along forward and backward directions and the resilient contacts 31F, 31R are near the front of the seal 30.

The steps 34 of the seal 30 are at longitudinal positions substantially aligned with the rear resilient contact 31R. Thus, the rear resilient contact 31R is deformed radially inwardly due to a backward-acting pushing force, of the receptacle Mc on the rear resilient contact 31R. Additionally, the resilient restoring force of the rear resilient contact 31R presses the steps 34 of the seal 30 against the outer peripheral surface of the fittable portion 11. Thus, the step 34 of the seal 30 will not disengage outwardly from the step 19 of the fittable portion 11, and loose movements of the resilient contacts 31F, 31R are prevented reliably.

Nonuniformity in the thickness of the walls of the fittable portion 11 can be reduced by causing an area of the outer surface of the fittable portion 11 aligned with the escaping groove 16 to project in a rib shape. Thus, "sink mark" deformations caused by thermal shrinkage during the resin molding of the housing 10 can be suppressed. As a result, dimensional stability is achieved. Furthermore, the step 19 of the fittable portion 11 effectively takes advantage of the rib 17 aligned with the escaping groove 16. Thus, the shape of the fittable portion 11 can be simplified as compared to a case where the step projects separately from the rib-shaped projection.

The invention is not limited to the above described and illustrated embodiment. For example, the following embodiments also are embraced by the technical scope of the invention as defined by the claims. Beside the following embodiments, various changes can be made without departing from the scope and spirit of the present invention as defined by the claims.

The contact surface and the receiving surface of the steps overhang with respect to the fitting direction of the fittable portion into the receptacle in the foregoing embodiment. However, they may be substantially normal to the fitting direction of the fittable portion according to the invention.

The steps of the seal are near the resilient contact along the fitting direction FD in the foregoing embodiment. However, they may be at a position not corresponding to the resilient contact.

The loose-moment preventing means are slightly behind the resilient contacts in the foregoing embodiment. However, they may be before the resilient contact portions according to the present invention.

The steps are provided around only part of the periphery in the foregoing embodiment. However, they may be continuous around substantially the entire periphery or may be arranged at a plurality of different positions around the periphery according to the present invention.

The step of the fittable portion takes advantage of the rib-shaped projection of the escaping groove in the terminal insertion space in the foregoing embodiment. However, it may be at a position different from the rib-shaped projection according to the present invention.

The loose-movement preventing means preferably are the steps in the foregoing embodiment. However, a projection may be provided on one of the inner peripheral surface of the seal and the outer peripheral surface of the fittable portion and a recess may be provided in the other thereof according to the present invention. Loose movements of the resilient contacts are prevented by the engagement of these projections and recesses.

The seal is substantially symmetrical with respect to the center axis parallel with the fitting direction in the foregoing embodiment. However, the shape thereof may be asymmetrical according to the present invention.

What is claimed is:

1. A watertight connector, comprising:

a housing for accommodating at least one terminal fitting;

a fittable portion fittable into and withdrawable from a receptacle of a mating connector, the fittable portion having an outer peripheral surface, an escaping groove being formed in an inner surface of a wall of the fittable portion facing a terminal insertion space in the housing for avoiding interference with an improper insertion preventing projection on the outer surface of the terminal fitting when the terminal fitting is inserted in proper orientation;

a substantially tubular seal mounted on the outer peripheral surface of the fittable portion and having an outer peripheral surface with at least one resilient contact configured for resilient contact with an inner peripheral surface of the receptacle;

fastening means on at least one of the fittable portion and the seal for preventing the seal from moving forward off the fittable portion; and loose-movement preventing means on at least one of the fittable portion and the seal for preventing loose backward movement of the resilient contact.

2. The watertight connector of claim 1, wherein the fastening means is at at least one of a rear end of the fittable portion and a rear end of the seal.

3. The watertight connector of claim 1, wherein the loose-movement preventing means are provided at the fittable portion and at the seal and are engageable with each other to prevent loose backward movements of the resilient contact.

4. The watertight connector of claim 1, wherein an area of the outer surface of the fittable portion corresponding to the escaping groove projects to form a rib-shaped projection, a front end of the rib-shaped projection defining the step.

5. The watertight connector of claim 1, wherein the fastening means comprises a stopper fit to the housing to engage the seal and to prevent the seal from moving forward.

6. The watertight connector of claim 1, wherein a single loose-movement preventing means is provided on each of the fittable portion and the seal along substantially the entire periphery thereof.

7. The watertight connector of claim 1, wherein a plurality of loose-movement preventing means are provided on the fittable portion and on the seal in a spaced manner along the periphery thereof.

8. A watertight connector, comprising:

a housing for accommodating at least one terminal fitting:

a fittable portion fittable into and withdrawable from a receptacle of a mating connector, the fittable portion having an outer peripheral surface;

a substantially tubular seal having an inner peripheral surface mounted on the outer peripheral surface of the fittable portion and having an outer peripheral surface with at least one resilient contact configured for resiliently contacting an inner peripheral surface of the receptacle;

fastening means on at least one of the fittable portion and the seal for preventing the seal from moving forward off the fittable portion;

loose-movement preventing means on at least one of the fittable portion and the seal for preventing loose backward movement of the resilient contact, wherein the loose-movement preventing means comprise steps formed on the outer peripheral surface of the fittable portion and on the inner peripheral surface of the seal, the steps having overhanging contact surfaces aligned at an acute angle to a fitting direction of the fittable portion into the receptacle and engaged with one another so that the seal will not disengage outwardly from the fittable portion.

9. The watertight connector of claim 8, wherein the step of the seal is aligned substantially longitudinally with the resilient contact.

10. A watertight connector, comprising:

a housing for accommodating at least one terminal fitting, the housing having a fittable portion with a front end for fitting in a receptacle of a mating connector, the fittable portion having an outer peripheral surface formed with at least one outwardly projecting step spaced rearwardly from the front end, the step having an undercut front surface defining an acute angle to portions of the outer peripheral surface between the step and the front end; and a substantially tubular seal having an inner surface mounted on the outer peripheral surface of the fittable portion and having an outer surface with at least one resilient contact configured for resilient contact with an inner peripheral surface of the receptacle, the inner surface of the seal having a step at a longitudinal position substantially aligned with the resilient contact, the step having a rewardly facing surface aligned at an acute angle to portions of the inner surface of the seal rewardly of the step, the acute angle of the rearwardly facing surface of the step of the seal substantially corresponding to the acute angle of the step on the outer peripheral surface of the fittable portion of the housing such that the step of the seal is engaged with the step on the fittable portion in substantially face-to-face contact for preventing loose backward movement of the seal and preventing the seal from disengaging outwardly from the step of the fittable portion, fastening means on the seal for preventing the seal from moving forward off the fittable portion.

11. The watertight connector of claim 10, wherein the fastening means is at an end of the seal opposite the resilient contact.

12. The watertight connector of claim 11, further comprising a stopper mounted to the housing and engaged with the fastening means of the seal to prevent the seal from moving forward.

* * * * *